United States Patent [19]

Platt

[11] 4,129,018

[45] Dec. 12, 1978

[54] ONE-PIECE AGITATOR WITH CLOTHES LIFTING CAMS

[75] Inventor: Clark I. Platt, St. Joseph, Mich.

[73] Assignee: Whirlpool Corporation, Benton Harbor, Mich.

[21] Appl. No.: 839,997

[22] Filed: Oct. 6, 1977

[51] Int. Cl.[2] ..... D06F 17/10
[52] U.S. Cl. ..... 68/134
[58] Field of Search ..... 68/131-134, 68/53, 54

[56] References Cited

U.S. PATENT DOCUMENTS

| | | | |
|---|---|---|---|
| Re. 18,280 | 12/1931 | Kirby | 68/133 |
| D. 100,861 | 8/1936 | Hume | D15/57 |
| D. 105,517 | 8/1937 | Geldhof | D248/283 |
| D. 127,576 | 6/1941 | Barber | 68/54 X |
| 1,543,323 | 6/1925 | Dehle | 68/134 |
| 1,629,391 | 5/1927 | Kemp et al. | 68/134 X |
| 1,632,866 | 6/1927 | Altorfer | 68/133 |
| 1,665,959 | 4/1928 | Graham et al. | 68/133 X |
| 1,688,031 | 10/1928 | Altorfer | 68/133 |
| 1,754,626 | 4/1930 | Holzhausen | 68/134 |
| 2,976,711 | 3/1961 | Smith | 68/134 X |

FOREIGN PATENT DOCUMENTS 1020189 11/1952 France.

OTHER PUBLICATIONS

Photographs Submitted by Applicant in Paper No. 2 of a 1964 Agitator Device.

*Primary Examiner*—Philip R. Coe
*Attorney, Agent, or Firm*—Hill, Gross, Simpson, Van Santen, Steadman, Chiara & Simpson

[57] ABSTRACT

An agitator for a vertical-axis automatic clothes washing machine has a plurality of vanes extending upwardly from a skirt thereof. A corresponding plurality of crescent-shaped, lobe-like cams projects outwardly and upwardly from a periphery of the skirt between the pairs of agitator vanes. Each cam extends approximately 33° upwardly from the horizontal and is geometrically defined by two edges forming a segment of the surface of a cone coaxial with the agitator. The inner edge of each cam has the radius of the circular perimeter of the agitator skirt with which the edge is colinear; the upper edge has a somewhat smaller radius. Lower vertical flat vane portions extend radially and upon impelling laundry liquid produce a low pressure pocket behind each vane. The cam edges impel the clothes upwardly as the agitator oscillates to and fro while the barriers provided by the vanes prevent laundry liquid from moving upwardly into the low pressure pocket, thereby promoting a successive movement of clothes downwardly, outwardly, upwardly, inwardly and downwardly again.

9 Claims, 7 Drawing Figures

ONE-PIECE AGITATOR WITH CLOTHES LIFTING CAMS

BACKGROUND OF THE INVENTION

1. Field of the Invention

The present invention relates to automatic washing machines employing vertical axis agitators to provide a generally toroidal rollover motion to clothes and wash fluid within the machine.

2. The Prior Art

When a washing basket is heavily loaded with clothes, the heavy load tends to crowd the agitator and often affects adversely achievement of a full rollover action. Maximum rollover is desired to expose all portions of the load to adequate scrubbing action.

Very efficient movement patterns for clothes within an automatic washing machine having a vertical axis agitator is one of toroidal rollover, for example, as accomplished by a so-called double acting auger agitator of the type disclosed and claimed in a series of patents issued to the same assignee as the present invention as exemplified by U.S. Pat. Nos. 3,987,508; 3,987,652; and 3,987,651.

Such rollover action is accomplished by providing a means for moving clothes down the agitator center post, radially outwardly from the oscillating agitator vanes, upwardly along the wall of the wash receptacle, and inwardly to the center post at the surface of the wash fluid, forming a toroidal pattern in the wash zone and within the washing liquid.

U.S. Pat. Nos. 1,543,323; 1,688,031 and 1,754,626 disclose automatic washing machines having raised rims on oscillating circular skirts. U.S. Pat. No. 1,629,391 and Re. 18,280 show non-oscillating flow deflectors in the bottom of wash receptacles of automatic washing machines. U.S. Pat. Nos. 1,632,866; 1,655,959; Des. 100,861, Des. 105,517 and Des. 127,576, and French Pat. No. 1,020,189 show agitators having generally circular skirts with upward convolutions in the circumferential direction thereon.

A prior art agitator device had a skirt portion and generally upright vanes having a wavy configuration throughout their vertical extent. Attached to a chordal section of the agitator skirt between each of the upright vanes was a flat or planar, crescent-shaped cam. Oscillation of the agitator and the crescent-shaped cams thereon in a body of water produced some additional agitation, the added agitation being directed generally in a vertical direction.

SUMMARY OF THE INVENTION

In view of the energy crisis and the increasing recognition of water shortages, it is likely that larger clothes loads are going to be laundered in washers but with proportionally less water than heretofore provided. The present invention is especially suited to rollover a larger quantity of clothes charged into a washing zone of a laundry machine.

An improved one-piece agitator having an outstanding center post and a lower skirt portion is mounted inside a wash basket or receptacle for rotational oscillation about a vertical axis. Each of the lower portions of the vanes defines a vertical plane including the axis of the agitator, with an outer, vertical edge of each vane extending to or slightly outwardly of the perimeter of the skirt. A corresponding plurality of substantially crescent-shaped cams or lobes is attached to the agitator skirt perimeter along a lowermost portion thereof, with each end of each cam spaced closely circumferentially adjacent one of the vertical vanes. The cams extend substantially 33° from the horizontal. The vertical flat faces of the vanes extend substantially above the highest, middle parts of the cams. The skirt and the cams define surfaces of two coaxial cones, wherein the perimeter of the skirt and the lower edges of the cams have a common radius, and wherein the upper edges of the cams have a slightly smaller radius. A reduced pressure is created behind each of the lower portions of the vanes upon oscillation of the agitator as wash liquid and articles therein are impelled outwardly by centrifugal action and the cams. Hence, downward movement of clothes and wash liquid from above into the zone is promoted. The upper edge of the cam operates to impel the clothes generally outwardly and upwardly.

THE DRAWINGS

THE PREFERRED EMBODIMENTS

Figure 1:
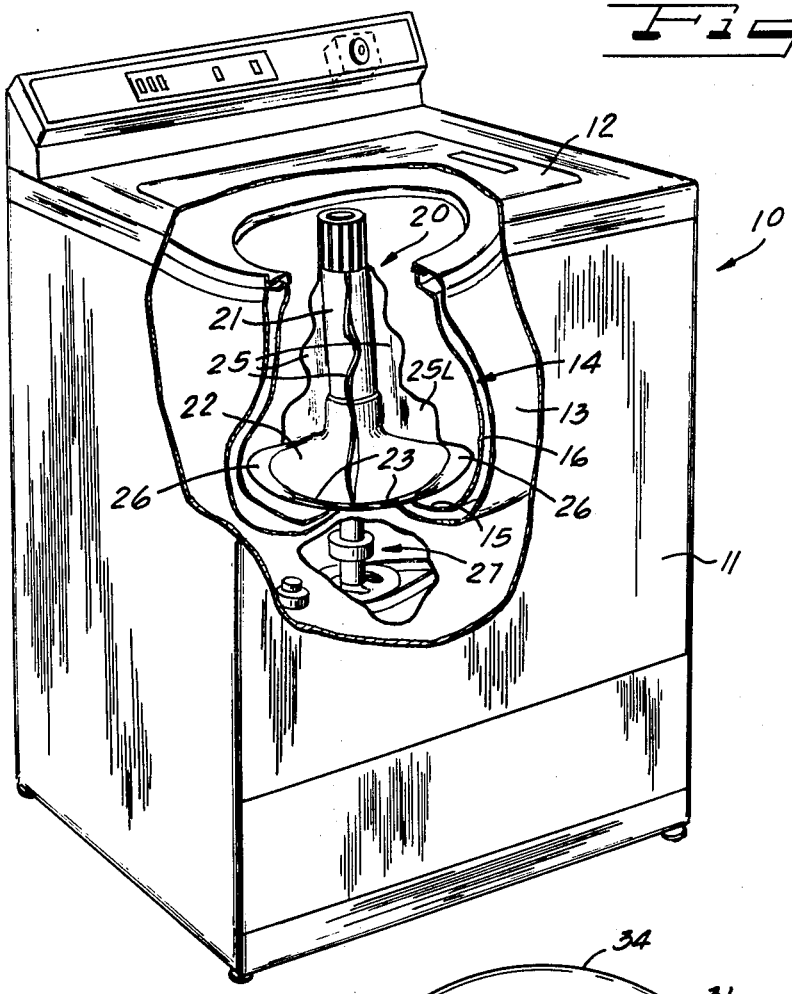
FIG. 1 is a perspective view of a washing machine with portions of the cabinet cut away to show the wash receptacle, agitator, and other internal parts thereof.

A washing machine 10 of the automatic, vertical axis type is shown generally in FIG. 1, comprising a cabinet 11 having a hinged lid 12 for permitting access to the interior of the machine 10. Within the cabinet 11 is an imperforate fluid retaining tub 13 and a perforate washing receptacle or basket 14 mounted coaxially therewithin. The basket 14 has a lower wall 15 and a side wall 16, the wall 16 being generally cylindrical.

An improved agitator 20 of the present invention is mounted coaxially within the tub 13 and the basket 14. The agitator 20 comprises an upstanding center post or barrel portion 21 and a lower, generally conical skirt portion 22 having a circular outer periphery 23. A plurality of fluid handling and scrubbing vanes 25 is formed integrally with the outer wall of the center post 21 and the upper surface of the skirt 23, in radial and vertical relation respectively. A corresponding plurality of crescent-shaped cams 26 is affixed to the peripheral rim 23 of the agitator skirt 22 between adjacent pairs of agitator vanes 25.

Driving means 27 drive the agitator 20 including the vanes 25 and cams 26 thereon in repetitive rotational oscillations within the clothes washing basket 14. The oscillatory arc of the agitator 20 is greater than 180° where three vanes 25 are provided. Where the oscillation arc effected by the drive means 27 is smaller, a greater number of vertical vanes 25 and cams 26 would be used to insure proper clothes circulation and scrubbing.

Figure 2:
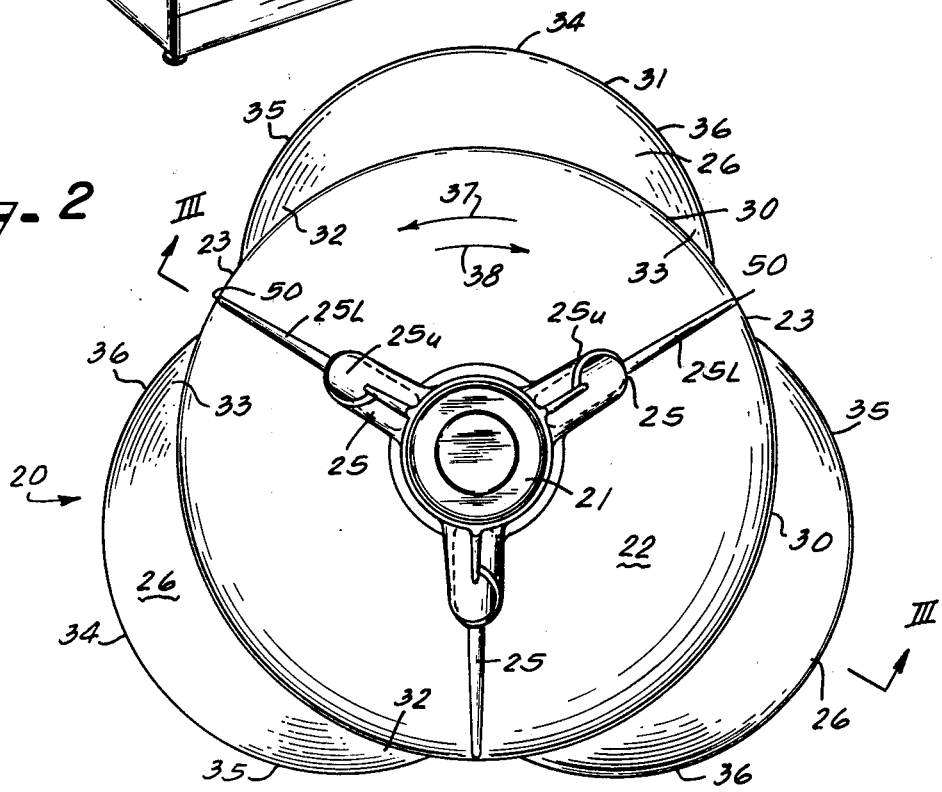
FIG. 2 is a top plan view of an agitator with camming surfaces thereon.
Figure 3:
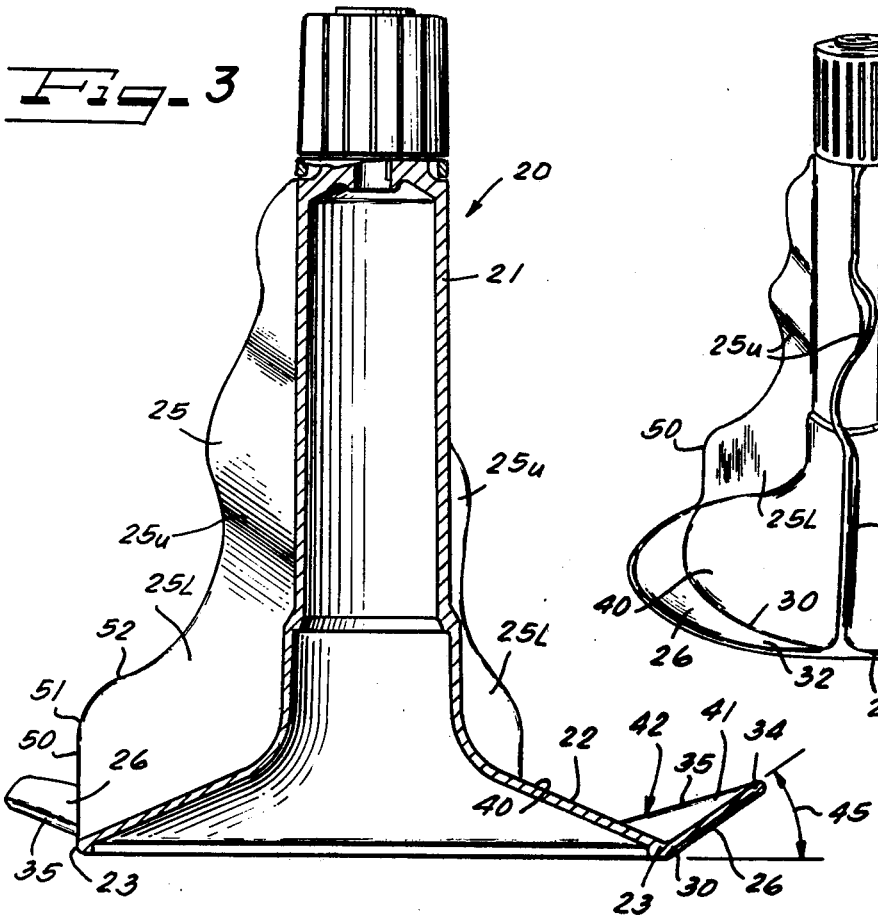
FIG. 3 is a side sectional view through the agitator, on line III—III of FIG. 2.
Figure 4:
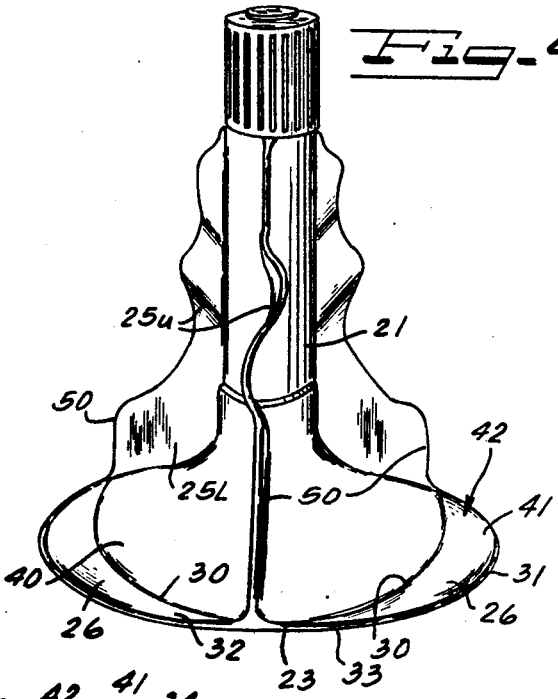
FIG. 4 is a perspective view of the agitator with cams of the present invention.

Referring to FIGS. 2, 3 and 4 the individual ones of the cams 26 are geometrically defined by edges 30 and 31, the edges forming or defining a portion of the area of a cone coaxial with the agitator 20. An inner one 30 of the edge lines has the same radius as the periphery 23 of the skirt 22. Thus, the lower edge 30 of each lifting cam 26 is colinear with such circular periphery 23. The second, free upper or outer edge 31 of each lifting cam 26 is defined by a somewhat smaller radius than that of the inner edge 30. Each outer edge 31 joins the periphery 23 of the skirt 22 at cusped cam ends 32, 33 formed at the periphery 23 of the skirt 22. In one preferred embodiment of the invention, the agitator skirt and lower edge 30 have a radius of 158 mm, and the radius of the upper edge 31 of the cams 26 is 126 mm (6.2 and 4.95 inches, respectively).

If the surfaces of the cams 26 were projected radially inwardly, there would be defined a cone surface having an axis coaxial with that of the agitator. Thus, upon oscillation the cams 26 merely cut through the laundry liquid without increasing torque and balanced torque, i.e. equal torque in each direction of oscillation may be achieved with the agitator of this invention.

Each cam 26 is symmetric about a line bisecting the angle defined between each two adjacent vanes 25, 25. Then each upper edge 31 has a highest point 34 defined on each such bisecting line. Portions of the upper edge 31 on either side of such point 34 providing alternating leading and trailing edges 35, 36, depending on the direction of oscillation or rotation 37, 38 of the agitator 20, as in FIG. 2. Upon counterclockwise rotation or oscillation 37, a forward portion 35 of the edge 31 is a leading edge, and the opposite portion 36 is a trailing edge. Upon reverse rotation 38, the functions of the edge portions 35, 36 also reverse. In accordance with the invention, each free, upper edge 31 joins the periphery 23 of the skirt 22 closely circumferentially adjacent each of the vanes 25. That is, as shown in FIG. 2, each cusped end 32, 33 of each cam 26 terminates at the periphery 23 of the skirt 22 at a point spaced slightly before the vane 25.

A further important structional feature of the cams 26 in relation to the agitator skirt 23 is illustrated in FIG. 3. First, the skirt 22 of the agitator 20 extends generally downwardly and outwardly from the agitator barrel 21 in a shallow conical configuration. Thus, an upper surface 40 of the skirt 22 is convex to wash fluid and articles of clothing and fabrics thereabove. An upper surface 41 of each of the lifting cams 26 forms a concavely shaped wall due to the shape of the respective cam edges 30, 31. A pocket area 42 is thereby formed between the convex surface 40 of the skirt and the concave surface 41 of the lifting cam 26 behind each respective vertical flat vane face 25L.

In accordance with the principles of the present invention, each of the vanes 25 has a sizeable lower portion 25L which is flat or planar and extends vertically from the skirt 22 and radially from the center post 21. An outer edge 50 of the lower portion 25L terminates the vane 25 vertically at or slightly beyond the radius of the periphery 23 of the skirt 22. The vertical outer edge 50 terminates at a point 51, with the lower portion 25L terminating radially thereabove along a tapered curve 52 which merges smoothly into a wavy upper portion 25U having a reduced radial extent. The upper termination 51 of the vertical end edge or wall 50 of the lower vane portion 25L is substantially above the vertical level of the highest, center points 34 of the upper, outer edges 31 of the lifting cams 26. The radial and vertical extent of the lower portions 25L of the vanes 25, and their flat or planar configuration is such that on each oscillation of the agitator 20 the laundry liquid adjacent thereto, is impelled outwardly and a low pressure zone is formed behind each of the vanes 25 in the respective pocket areas 42. Since nature abhors a vacuum, wash liquid and clothing articles from above tend to rush in to fill the low pressure area or pocket 42. The wall surfaces of the cams 26 prevent any such action from below and consequently the movement is from above, along the barrel of the center post 21. Simultaneously with such reduced pressure the leading edges 35 or 36 of the cams 26 urge or impel the articles of clothing and fabrics in the wash liquid upwardly and outwardly within the basket 14. An inclination angle 45, as in FIG. 3, of 33° between the upper surface 41 of the cam 26 and a horizontal line radial of the agitator 20 has been found to be most effective. Such angle of the upper edge 31 provides a good lifting movement without increasing torque requirements for the agitator drive 27 by an excessive amount. A clearance of several inches, about 2 ½ inches or 65 mm, between the highest and outermost points 34 of the cams 26 and the side wall 16 of the basket 14 has been found to give a good, sweeping coverage for the outer portion of the bottom of the washing basket 14 above the lower wall 15 thereof, while avoiding pinching of fabrics between the walls of the cams 26 and the basket wall 16.

Figure 5:
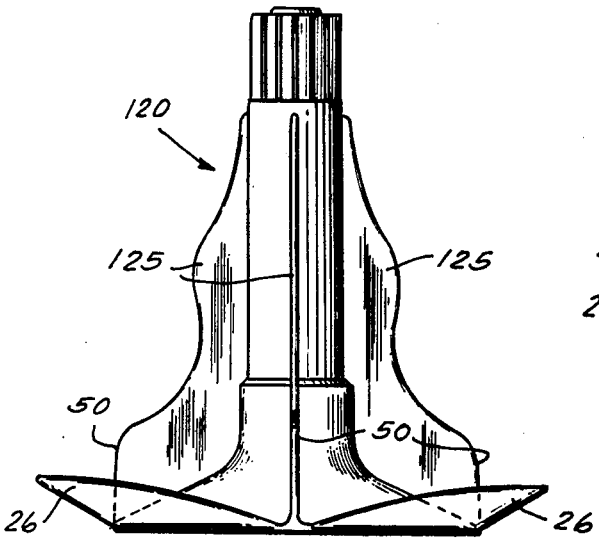
FIG. 5 is a side elevational view of an alternate configuration of the agitator vanes.

As shown in FIGS. 4 and 5, the present invention is useful either with vanes 25 formed with reverse "S" shaped curves which add stiffness to the vanes 25 and aid somewhat in directing water flow radially outwardly from the center post 21, or with straight vanes 125 which do not have such reverse "S" curves in the upper portion 25U. Little if any reduction in washing effectiveness is found when using the straight vanes 125 in comparison to the curved vanes 25, and torque requirements in opposite directions of oscillation 37, 38 are equalized. It has been found, in accordance with the invention, that the shape of the lower portions 25L of the vanes contributes substantially to torque requirements of the drive means; having these portions flat significantly contributes to equalization of torque requirements. Torque equalization is highly desirable from a design standpoint since it permits optimizing the drive means so as to provide equal torque in either direction of rotation.

Further, the lowermost end edges 32, 33 of the cams 26 are radially and axially aligned with the adjacent portions of the skirt, as in FIGS. 2, 4, and 5. Articles of clothing and fabric thus will not be forced under the skirt or cams to catch, snag, or jam.

Figure 6:
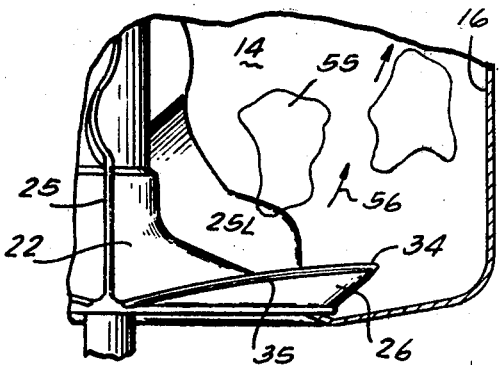
FIG. 6 is an enlarged, detailed view of a lower portion of the wash receptacle, showing lifting movement imparted to articles of clothing upon movement of the lifting cams.
Figure 7:
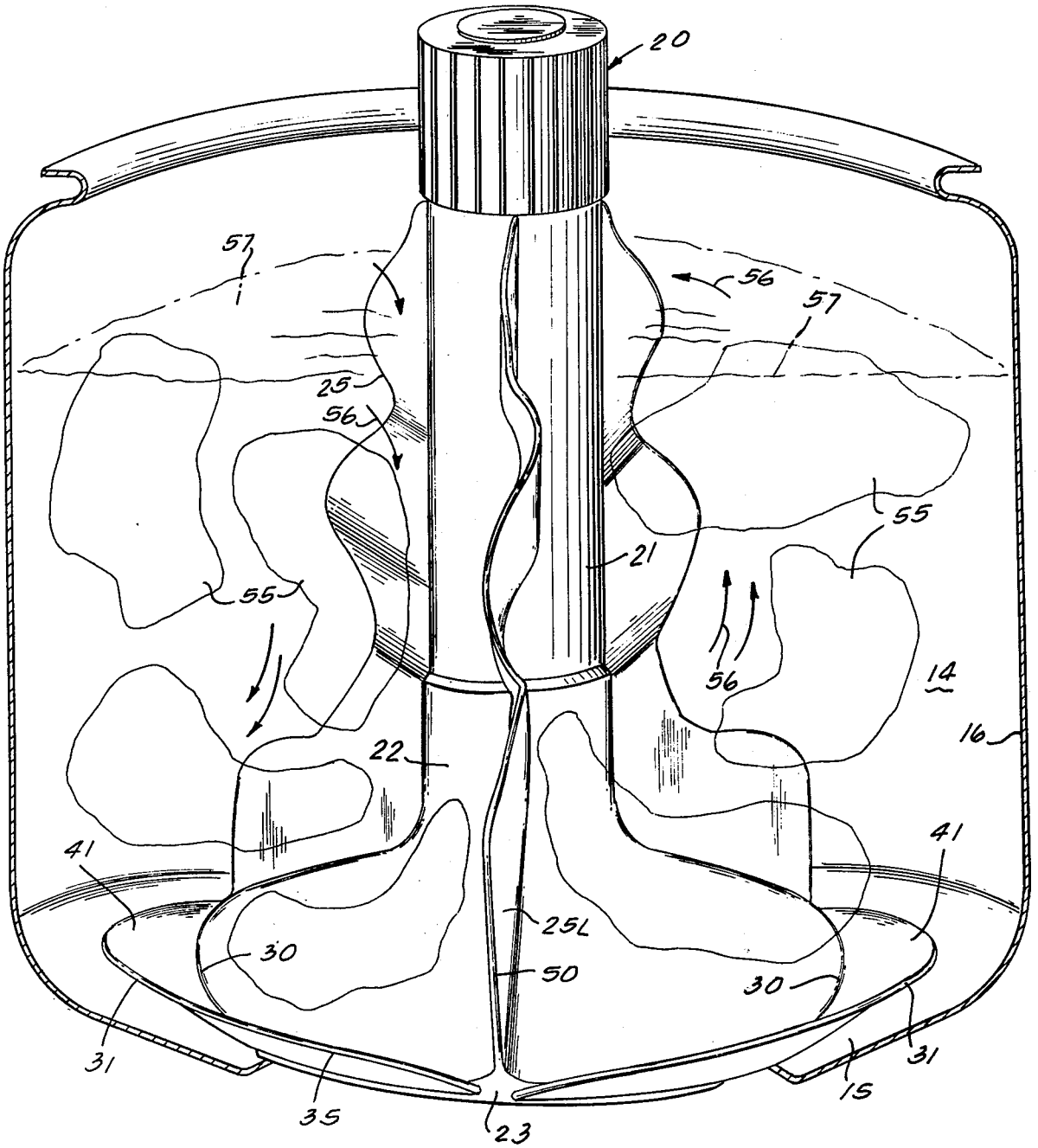
FIG. 7 is a perspective view, partly cut away, of a wash receptacle and agitator with lifting cams thereon, in operation.

In operation, articles of fabrics or clothing 55 are placed within the washing basket 14 about the agitator 20, and the basket 14 and the tub 13 are filled with wash fluid. As shown by the arrows 56 in FIGS. 6 and 7, the articles of fabrics or clothing 55 are urged through a torodial pattern of movement within the wash fluid as indicated by a water level 57. As the agitator 20 oscillates in to and fro motions 37, 38, the fabrics or clothing articles 55 are impelled outwardly at the bottom of the clothes basket 14 by the edges of the vanes 25 of the cams 26 along the leading edge portions 35 or 36 thereof. The flat vertical vane faces create a low pressure area immediately behind each vane and in a pocket area above each cam. The cam walls prevent filling of such area from below. The outward and upward displacement of the articles 55 in the lower portion of the basket 14 and the low pressure cause articles within the basket 14 to move downwardly along the center post 21 of the agitator 20. Even when the load of clothing articles 55 within the basket 14 is heavy, and the wash load/water ratio is small the positive lifting action of the cams 26 and the low pressure phenomenon of the vanes assures positive rollover of the load in the machine.

Although various minor modifications may be suggested by those versed in the art, it should be understood that I wish to embody within the scope of the patent warranted hereon all such modifications as reasonably and properly come within the scope of my contribution to the art.

The embodiments of the invention in which an exclusive property or privilege is claimed are defined as follows:

1. In an improved agitator for an automatic clothes washing machine, the agitator having a skirt having a circular outer periphery and a center post extending coaxially upwardly therefrom, the improvement of:

a plurality of agitator vanes extending generally radially of the center post and upwardly of the skirt, and a corresponding plurality of crescent-shaped cams affixed to the periphery of the skirt, each cam being located between a pair of said vanes, each of said agitator vanes having a flat vertically extending lower portion which extends radially outwardly at least to a vertical line superjacent the periphery of the skirt and which is flat and coplanar with the axis of the agitator and extends vertically along said line to a level above said cams to form a low pressure area behind the vane when oscillated through a body of laundry liquid, said cams being disposed to form portions of the surface of a cone coaxial with the agitator and having concavely shaped walls to prevent liquid entering the low pressure area from below, each said cam having opposite cusped ends each of which terminates closely circumferentially adjacent one of said vanes, and each said cam having a free edge extending upwardly and outwardly from the periphery of the skirt at approximately a 33° angle from the horizontal to impel clothes engaged by said edge upwardly and outwardly, whereby the clothes and fabrics being laundered are drawn downwardly upon oscillation of the agitator in a laundry liquid into a low pressure area behind the lower portions of the agitator vanes and above the skirt and inwardly of the cams and are cammed upwardly and outwardly from the agitator in the machine.

2. An improved agitator as defined in claim 1, further defined by:

the lower portion of each said vane terminating radially outwardly along said vertical line and along a tapered edge extending inwardly and upwardly toward the agitator center post.

3. An improved agitator as defined in claim 1, further defined by:

the flat lower portions of the agitator vanes extending vertically upwardly above the agitator skirt periphery and well above all parts of the free edges of the crescent-shaped cams.

4. An improved agitator as defined in claim 1, further defined by:

each of the agitator skirt periphery and the free edges of the cams having a lower side; and said lower sides of the skirt periphery and of the ends of the free outer edges of the cams coincide vertically, whereby articles being washed will not be caught beneath said cams.

5. In an automatic washing machine of the vertical axis type, the improvement of a one-piece agitator having a lower skirt with an outer, lower, circular periphery, and an upper surface which is convex to wash fluid and articles of clothing and fabrics thereabove, a center post extending upwardly from said skirt, a plurality of upright vanes connected to the skirt and center post, and a corresponding plurality of crescent-shaped cams affixed to the periphery of the skirt between adjacent pairs of said vanes, said improvement comprising:

each of the vanes having a flat planar lower portion which extends radially from the center post and vertically from the skirt and having an outer edge terminating vertically at the periphery of the skirt and vertically at a point substantially above an axially highest point of the cams; and each of said cams being disposed to form portions of the surface of a cone coaxial with the agitator and being symmetric about a line bisecting the angle defined between two vanes and having a free upper edge joining the skirt closely circumferentially adjacent each of the vanes;

each of said cams further having an upper concave surface such that a pocket area is formed between said convex surface of said skirt and said concave surface of said cam behind each vane, whereby upon each oscillation of said agitator the laundry liquid adjacent thereto is impelled outwardly and a low pressure zone is formed behind each of said vanes in said pocket area.

6. The improvement of claim 5, further defined by:

the upper surface of each cam extending at an angle of substantially 33° above a line normal to the axis of the agitator.

7. The improvement of claim 6, wherein the skirt also forms a conical surface coaxial with the agitator and the cone of the cams.

8. In a washing machine of the vertical axis type having a wash tub for containing wash liquid and a wash basket therein containing items to be washed and having a lower wall and a cylindrical side wall, an improved agitator for effecting toroidal rollover of said liquid and items upon oscillation of said agitator, the agitator comprising:

a generally conical skirt having a circular outer periphery having a lower edge closely overlying the lower wall of the basket and spaced inwardly from the side wall of the basket;

a center post extending upwardly from the skirt and coaxial therewith;

a plurality of agitator vanes extending radially from the center post and upwardly from the skirt, each of said vanes having a lower portion which is flat and axially and radially oriented and a radially outer edge which is axially aligned substantially with the periphery of the skirt;

a corresponding plurality of crescent-shaped cams affixed to the periphery of the skirt and extending upwardly and outwardly therefrom and spaced inwardly from said basket side wall, each said cam comprising a continuous surface lying on a cone coaxial with the agitator, having an inner edge colinear with the skirt periphery and an outer edge raised substantially 33° above the horizontal therefrom;

each said cam further having opposite cusped ends at junctures of the inner and outer edges, said ends being spaced closely adjacent the vanes and merging radially with the lower edge of the skirt periphery, and the outer edge rising to a high point between the adjacent vanes but axially below a highest point of the radially outer edge of the lower portions thereof, whereby the clothes and fabrics being washed are drawn downwardly upon oscillation of the agitator in a wash fluid and into a low pressure area developed behind the lower portions of the agitator vanes, above the skirt, and inwardly of the cams and are cammed upwardly and outwardly from the agitator along a toroidal rollover path.

9. The improved agitator as defined in claim 8, wherein the high points of the outer edges of the cams are spaced approximately 2–3 inches (5–8 mm) from the side wall of the wash basket.

* * * * *